US008827594B2

(12) United States Patent
Pai

(10) Patent No.: US 8,827,594 B2
(45) Date of Patent: Sep. 9, 2014

(54) LEVELING DEVICE FOR POURED CONCRETE FLOORS

(71) Applicant: Ming-Cheng Pai, Pingtung County (TW)

(72) Inventor: Ming-Cheng Pai, Pingtung County (TW)

( * ) Notice: Subject to any disclaimer, the term of this patent is extended or adjusted under 35 U.S.C. 154(b) by 0 days.

(21) Appl. No.: 13/866,160

(22) Filed: Apr. 19, 2013

(65) Prior Publication Data

US 2013/0294834 A1 Nov. 7, 2013

(30) Foreign Application Priority Data

May 1, 2012 (TW) ..... 101208152 U

(51) Int. Cl.
*E01C 19/22* (2006.01)
*E04G 21/10* (2006.01)
*E01C 19/40* (2006.01)

(52) U.S. Cl.
CPC ..... *E01C 19/405* (2013.01); *E04G 21/10* (2013.01)
USPC ..... 404/118; 404/114; 404/120

(58) Field of Classification Search
USPC ..... 404/114, 118, 120
See application file for complete search history.

(56) References Cited

U.S. PATENT DOCUMENTS

| | | | | |
|---|---|---|---|---|
| 5,909,981 | A * | 6/1999 | Neuber, Jr. | 404/112 |
| 6,238,135 | B1 * | 5/2001 | Rower | 404/84.5 |
| 7,850,396 | B2 * | 12/2010 | Pietila et al. | 404/96 |
| 7,909,533 | B2 * | 3/2011 | Quenzi et al. | 404/114 |
| 8,182,173 | B2 * | 5/2012 | Lickel | 404/118 |
| 8,360,681 | B1 * | 1/2013 | Hebert | 404/114 |
| 2007/0116520 | A1 * | 5/2007 | Quenzi et al. | 404/114 |

* cited by examiner

*Primary Examiner* — Thomas B Will
*Assistant Examiner* — Katherine Chu
(74) *Attorney, Agent, or Firm* — Rosenberg, Klein & Lee

(57) ABSTRACT

A concrete floor leveling device includes a transmission device and a power source is located in a body and connected to wheels which are connected to the body. A connection unit is connected to the body and a blade is connected to the body by the connection unit. The power source outputs a stable power to drive the blade to level the concrete floor and to ensure that the blade levels the concrete floor with even force.

5 Claims, 5 Drawing Sheets

LEVELING DEVICE FOR POURED CONCRETE FLOORS

BACKGROUND OF THE INVENTION

1. Fields of the invention

The present invention relates to a concrete floor leveling device, and more particularly, to a concrete floor leveling device with stable output power to evenly drive the blade of the leveling device to ensure the leveling of the concrete floors.

2. Descriptions of Related Art

The conventional concrete floor leveling device has to be consistently operated to level the recently poured concrete floor, and this requires a lot of labor time. Because the conventional concrete floor leveling device is manually operated so that the blade cannot be evenly moved and the quality for leveling the poured floor is not satisfied.

The present invention intends to provide a concrete floor leveling device which outputs a stable and even force to the blade so as to level the surface of the recently poured concrete floor.

SUMMARY OF THE INVENTION

The present invention relates to a concrete floor leveling device and comprises a transmission device and a power source is located in a body and connected to wheels which are connected to the body. A connection unit is connected to the body and a blade is connected to the body by the connection unit.

The power source outputs a stable power to drive the blade to level the concrete floor and to ensure that the blade levels the concrete floor with even force. By using the present invention, the quality is obtained and the concrete floor is even and flat.

The primary object of the present invention is to provide a concrete floor leveling device which provides a stable output force to drive the blade to evenly level the concrete floor.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
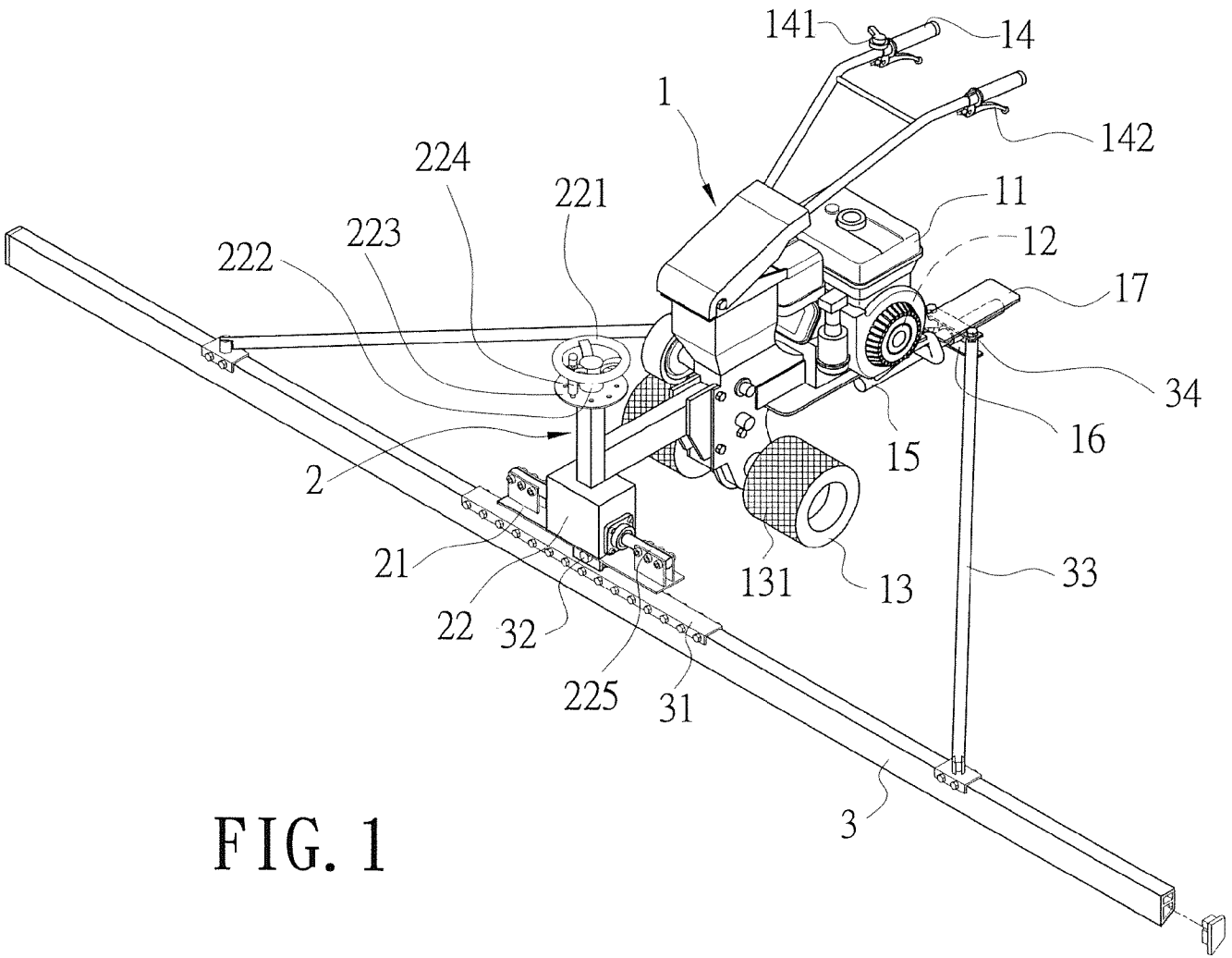
FIG. 1 is a perspective view to show the concrete floor leveling device of the present invention.
Figure 2:
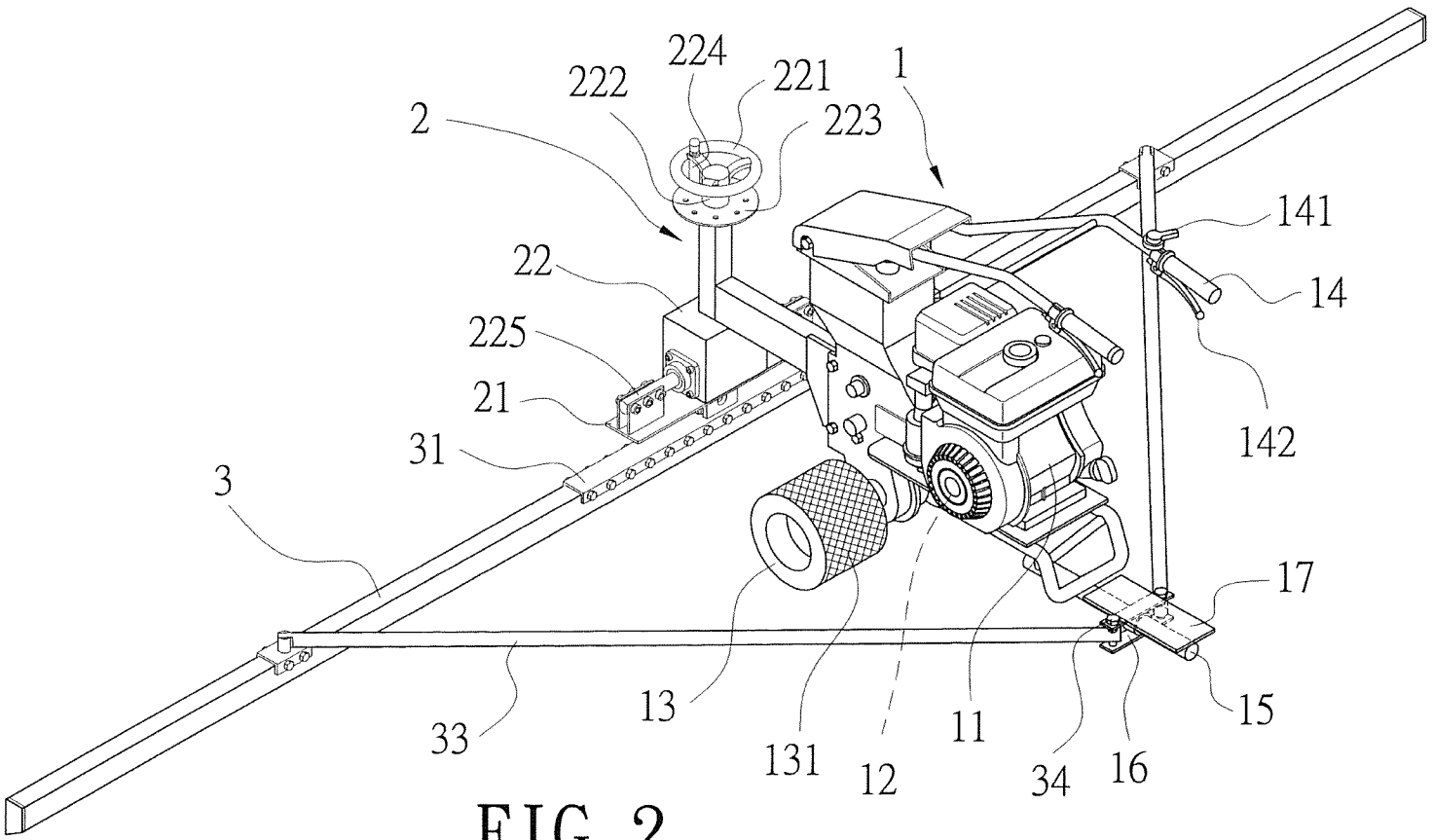
FIG. 2 is another perspective view to show the concrete floor leveling device of the present invention.

Referring to FIGS. 1 and 2, the concrete floor leveling device of the present invention comprises a transmission device 1, a connection unit 2 and a blade 3.

The transmission device 1 comprises a body 11 and a power source 12 is located in the body 11. The power source 12 is connected two wheels 13 connected to two sides of the body 11. Each of the wheels 13 has a tread 131 which is composed multiple alternative protrusions and recesses. A handle 14 is connected to the body 11 and has a switch 141 and a braking unit 142 connected thereto. The switch 141 and the braking unit 142 are connected the power source 12. A main shaft 15 is connected to the rear end of the body 11 and a connection member 16 is connected to the main shaft 15. A pedal 17 is connected on the connection member 16.

Figure 3:
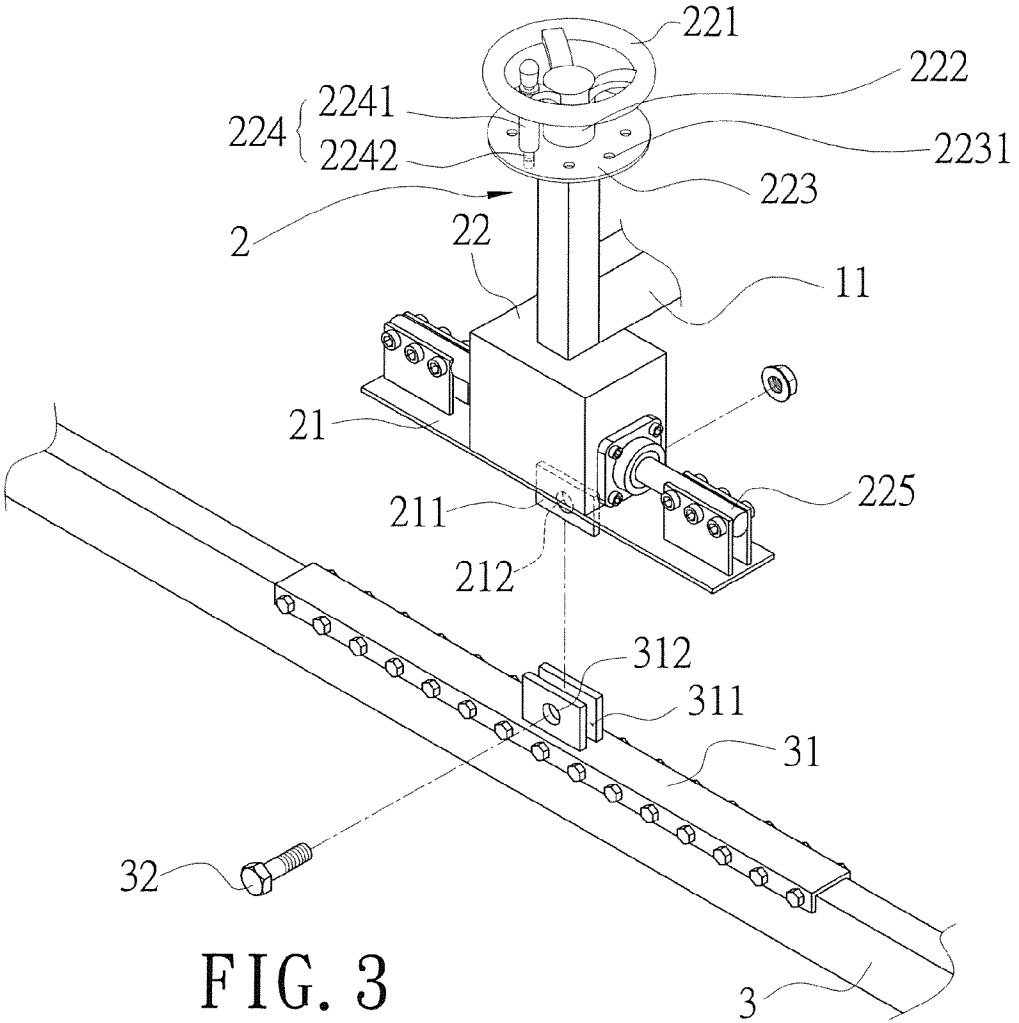
FIG. 3 is an exploded view to show the concrete floor leveling device of the present invention.

As shown in FIG. 3, the connection unit 2 is connected to the front end of the body 11 so as to be connected to the blade 3 and the body 11 of the transmission device 1. The connection unit 2 comprises an installation frame 21 and a tilt adjustment unit 22. The tilt adjustment unit 22 of the connection unit 2 has a ring 221 and an active shaft 222 is located beneath the ring 221. A positioning disk 223 is fixed to the body 11 and located corresponding to the ring 221. The positioning disk 223 has multiple positioning holes 2231 and the ring 221 has a pin 224 which is inserted into one of the positioning holes 2231. The pin 224 has a sleeve 2241 fixed to the ring 221 and an insertion 2242, wherein the insertion 2242 extends through the sleeve 2241. A resilient member is located between the sleeve 2241 and the insertion 2242. The active shaft 222 extends into the body 11 and is engaged with the gear set. The gear set is connected with a passive shaft 225 extending into the body 11. The installation frame 21 is located at a lower portion of the body 11 and connected to the passive shaft 225. The installation frame 21 has a plate 211 and the plate 211 has a locking hole 212.

The blade 3, as shown in FIG. 3, has a vertical front face and the lower end of the blade 3 extends inclined upward. The blade 3 has a connector 31 which has a slot 311 in which the plate 211 is inserted. The locking hole 212 of the plate 211 is located corresponding to locking holes 312 of the walls of the slot 311. A locking member 32 extends through the locking hole 212 of the plate 211 and the locking holes 312 of the walls of the slot 311 to secure the plate 211 in the slot 311. Two respective ends of two links 33 are connected to the blade 3 and two respective second ends of the two links 33 are connected to the connection member 16. Locking members 34 extend through the links 33 and the connection member 16 to connect the links 33 and the connection member 16.

Figure 4:
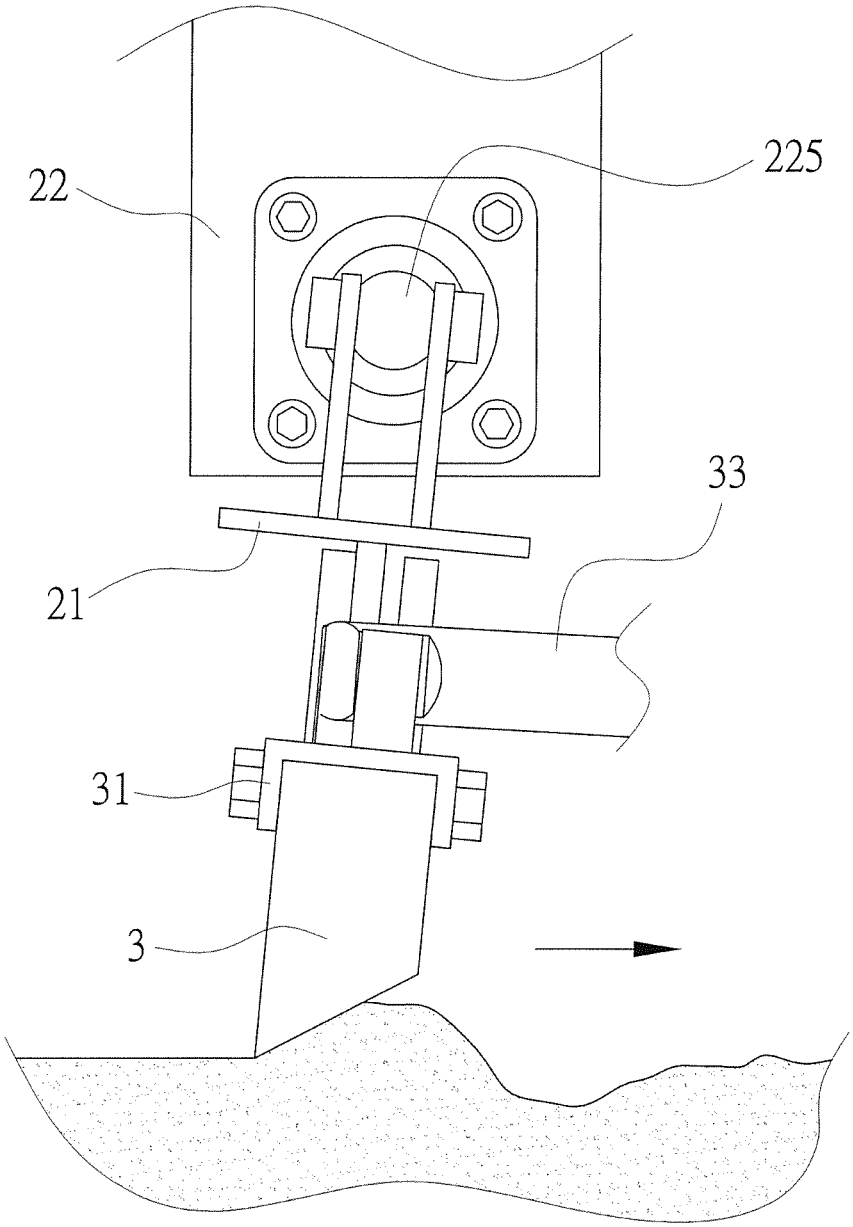
FIG. 4 shows the adjustment of the blade of the concrete floor leveling device of the present invention.
Figure 5:
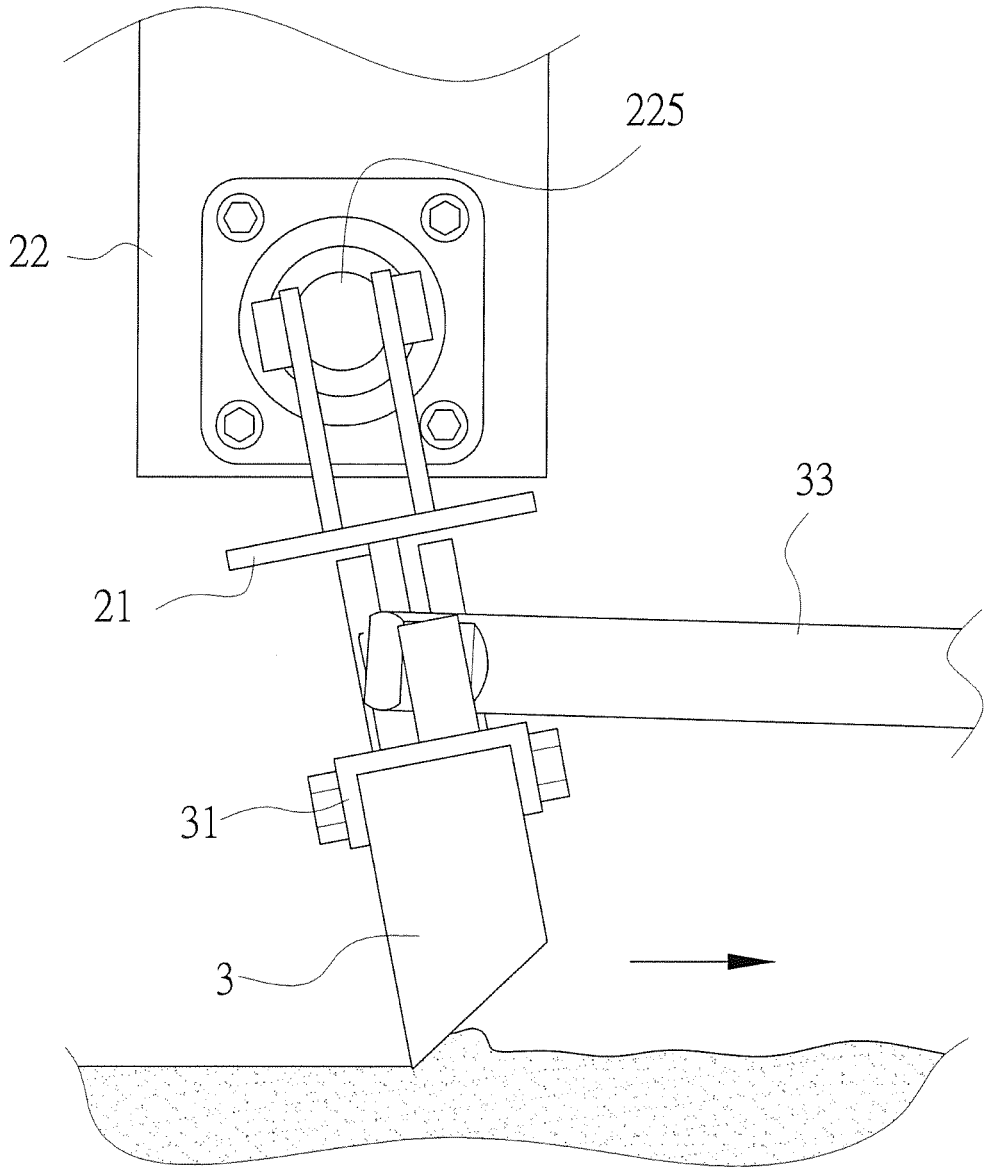
FIG. 5 shows another adjustment of the blade of the concrete floor leveling device of the present invention.

When leveling the concrete floor, as shown in FIGS. 1 and 2, the blade 3 is in contact with the concrete floor and the blade 3 is used to level the concrete floor when the concrete floor is solid about 60% to 70%. The inclination of the blade 3 is adjusted according to the condition of the concrete floor. When in use, the insertion 2242 of the pin 224 is removed from the positioning hole 2231 of the positioning disk 223 and the ring 221 on the tilt adjustment unit 22 is rotated, so as to rotate the active shaft 222 which drives the passive shaft 225 to rotate an angle via the gear set. The passive shaft 225 is pivoted an angle relative to the installation frame 21 so that the blade 3 is set at an angle as shown in FIGS. 4 and 5. Therefore, the blade 3 can be positioned according to the concrete floor which is higher than a pre-set standard level as shown in FIG. 4, or to the concrete floor which is lower than a pre-set standard level as shown in FIG. 5. After the blade 3 is in contact with the concrete floor, the pin 224 is released so that the insertion 2242 is inserted into the positioning hole 2231 by the resilient member located between the sleeve 2241 and the insertion 2242 to set the blade 3.

The user holds the grips of the handle 14 and activates the switch 141 and the power source 12 which drives the wheels 13 to move the blade 3 of the body 11 to move on and level the concrete floor. The blade 3 is driven by the power source 12 which outputs steady force to ensure that the blade 3 to move by an even force so that the concrete floor can be leveled. The present invention improves the shortcomings of the manual operation of the conventional leveling device. Besides, only one user is required to operate the leveling device of the present invention and the powerful transmission device 1 increases the efficiency for leveling the concrete floor and saves operation time.

The blade 3 is securely connected to the installation frame 21 of the connection unit 2 by the connector 31 on the middle portion thereof, the links 33 on the two ends of the blade 3 are connected to the connection member 16 of the transmission device 1, so that the blade 3 is firmly positioned by three points. The blade 3 is stably moved by the transmission device 1 and does not shake, so that the concrete floor is leveled efficiently.

Each of the wheels 13 has the tread 131 which provides sufficient friction when the wheels 13 move on the concrete floor. The tread 131 has shallow protrusions and recesses so as not to create wheel traces on the concrete floor.

While we have shown and described the embodiment in accordance with the present invention, it should be clear to those skilled in the art that further embodiments may be made without departing from the scope of the present invention.

What is claimed is:

1. A concrete floor leveling device comprising:

a transmission device having a body and wheels connected to the body, a power source located in the body and connected to the wheels, and a connection unit connected to the body and a blade connected to the body by the connection unit;

wherein the connection unit has an installation frame and a tilt adjustment unit, the installation frame is connected to the blade, the tilt adjustment unit connected between the body and the installation frame; and wherein the tilt adjustment unit of the connection unit has a ring and an active shaft which is located beneath the ring, a gear set is located in the body, the active shaft extends into the body and is engaged with the gear set, the gear set is connected with a passive shaft extending into the body, the installation frame is located at a lower portion of the body and connected to the passive shaft.

2. The device as claimed in claim 1, wherein the tilt adjustment unit of the connection unit has a positioning disk fixed to the body and the positioning disk is located corresponding to the ring, the positioning disk has multiple positioning holes, the ring has a pin which is inserted into one of the positioning holes.

3. The device as claimed in claim 1, wherein the installation frame has a plate and the blade has a connector which has a slot in which the plate is inserted, the plate has a locking hole and walls of the slot each have a locking hole, a locking member extends through the locking hole of the plate and the locking holes of the walls of the slot to secure the plate in the slot.

4. The device as claimed in claim 3, wherein two respective ends of two links are connected to the blade, a main shaft is connected to the transmission device and located in opposite to the blade, a connection member is connected to the main shaft, two respective second ends of the two links are connected to the connection member, locking members extend through the links and the connection member to connect the links and the connection member.

5. The device as claimed in claim 4, wherein each of the wheels of the transmission device has a tread formed thereon.

* * * * *